US005494163A

United States Patent [19]

Apps

[11] Patent Number: 5,494,163

[45] Date of Patent: Feb. 27, 1996

[54] ADJUSTABLE BAIL TRAY

[75] Inventor: William P. Apps, Anaheim, Calif.

[73] Assignee: Rehric Pacific Company, Inc., Los Angeles, Calif.

[21] Appl. No.: 151,012

[22] Filed: Nov. 12, 1993

[51] Int. Cl.[6] ..... B65D 21/04

[52] U.S. Cl. ..... 206/506; 206/507

[58] Field of Search ..... 206/505, 506, 206/507

[56] References Cited

U.S. PATENT DOCUMENTS

| | | | |
|---|---|---|---|
| Re. 32,223 | 8/1986 | Kreeger . | |
| D. 224,366 | 7/1972 | Rehrig . | |
| 1,689,217 | 10/1928 | White . | |
| 2,134,875 | 11/1938 | Henze . | |
| 2,609,120 | 9/1952 | Williams . | |
| 3,169,659 | 2/1965 | Blackmore . | |
| 3,220,603 | 11/1965 | Bromley . | |
| 3,675,815 | 7/1972 | Rehrig . | |
| 3,951,265 | 4/1976 | Carroll . | |
| 4,106,623 | 8/1978 | Carroll et al. | 206/506 |
| 4,109,791 | 8/1978 | Clipson et al. . | |
| 4,241,831 | 12/1980 | Locatelli | 206/506 |
| 4,247,004 | 1/1981 | Bird . | |
| 4,391,369 | 7/1983 | Stahl et al. . | |
| 4,423,813 | 1/1984 | Kreeger et al. | 206/506 |
| 4,440,302 | 4/1984 | Ehrman et al. . | |
| 4,466,541 | 8/1984 | Tabler et al. . | |
| 4,643,310 | 2/1987 | Deaton et al. | 206/506 |
| 4,671,411 | 6/1987 | Rehrig et al. . | |
| 4,759,451 | 7/1988 | Apps . | |
| 4,848,578 | 7/1989 | Schäfer . | |
| 4,863,062 | 9/1989 | Holliday . | |
| 4,905,833 | 3/1990 | Kreeger et al. . | |
| 4,982,844 | 1/1991 | Madan et al. . | |

FOREIGN PATENT DOCUMENTS

| | | |
|---|---|---|
| 368713 | 10/1989 | European Pat. Off. . |
| 2678585 | 7/1991 | France . |
| 3511321 | 3/1985 | Germany . |
| 3521894 | 6/1985 | Germany . |
| 2171980 | 10/1983 | United Kingdom . |
| 2129401 | 10/1983 | United Kingdom . |
| 2137167 | 10/1984 | United Kingdom . |
| 2141778 | 1/1985 | United Kingdom . |
| 2180821 | 4/1987 | United Kingdom . |
| 2209737 | 5/1989 | United Kingdom . |

*Primary Examiner*—Steven M. Pollard
*Attorney, Agent, or Firm*—Banner & Allegretti, Ltd.

[57] ABSTRACT

A nestable and stackable tray for transporting and storing articles having a mechanism for easily adjusting the distance between the floors of trays which are nested or stacked. By adjusting the distance between the floors of nested or stacked trays, the trays can be selectively made to stack at different heights to thereby accommodate differently stacked articles. In a first preferred embodiment, two bail members employed and each preferably hingedly connected to an opposing sidewall. The bail members are movable between three positions: a nested position, a high-stacked position and a low-stacked position. Movement between the different positions is accomplished by rotating and laterally moving the bails. In a second preferred embodiment, the tray has opposing sidewalls of different heights, that is, one set of opposing sidewalls are taller than the other set. Bail members are hingedly connected to each sidewall and are selectively movable between two positions: a nested position and a stacked position. Movement between the different positions is accomplished simply by rotating the bail members, no lateral movement of the bails is involved. Three configurations are possible however, since the sidewalls are of varying heights. Using only the bails associated with the higher set of opposing sidewalls provides a high-stacked configuration of adjacent trays; using only the bails associated with the lower set of opposing sidewalls provides a low-stacked configuration of adjacent trays; and setting all of the bails in the nested position provides a nested configuration of adjacent trays.

8 Claims, 8 Drawing Sheets

ADJUSTABLE BAIL TRAY

BACKGROUND OF THE INVENTION

The present invention relates to a nestable and stackable tray for transporting and storing articles. More particularly, the invention relates to trays having a mechanism for easily adjusting the distance between the floors of trays which are nested or stacked. By adjusting the distance between the floors of nested or stacked trays, the trays can be selectively made to stack at different heights to thereby accommodate articles of different heights. The empty trays can also be nested to accommodate differently sized articles.

Although numerous uses are contemplated, the present invention is particularly advantageous for the transport and storage of bread loaves and buns and similar articles where the articles themselves cannot be used to support the weight of trays stacked alone, for fear of damaging the articles. This type of stackable tray is significantly different from stackable trays wherein the articles in one tray support the trays above it, such as typical trays for carrying cans or bottles.

An example of a prior art stacking and cross-nesting tray is disclosed in U.S. Pat. No. 3,675,815 to Rehrig which is assigned to the same assignee as the present application, and the entire disclosure of which is hereby incorporated by reference.

Another example of a prior art stacking and nesting tray is disclosed in U.S. Pat. No. 4,759,451 to Apps which is also assigned to the same assignee as the present application, and the entire disclosure of which is hereby incorporated by reference. Apps discloses a multi-level stacking/nesting tray having an interlocking stacking leg/slot configuration. A plurality of slots are arranged parallel to one another on the outsides of the end walls of the tray. The slots are also configured so that the terminating point of each of the slots of a particular group lies substantially along the same vertical line, The slots receive stacking legs which extend from the exterior surface of the end walls of the tray at the location of the slots and are configured to permit insertion of the legs into the slots of another tray. The slots have progressively lower terminating points to permit varying levels of stacking.

Although Apps provides different stacking levels, the aligning and inserting of the legs into the correct slots may not be accomplished as quickly as desired, especially if the user is hurried. Moreover, since slots corresponding to the same level are vertically aligned, if a stack of trays having different levels is formed by inserting successive stacking legs into different groups of slots, the stack would not be perfectly vertically aligned and therefore may lose some stability. In other words, if a single stack of trays includes successive trays which are nested, stacked at the highest level and stacked at intermediate levels, the trays would not be vertically aligned. A stack of trays as taught by Apps would only be perfectly aligned vertically if the same group of slots is used in each and every tray in the stack thus preventing differently sized articles from being stored in successive trays in a stack.

SUMMARY OF THE INVENTION

Accordingly, it is a principal object of the present invention to provide a nesting and stacking tray which provides a quick conversion between stack heights.

It is another object of the present invention to provide a nesting and stacking tray which forms a vertically aligned stack of tray regardless of the distances between successive trays, that is, whether successive trays are nested, high-stacked or low-stacked.

A still further object of the present invention is to provide a nesting and stacking tray which makes efficient use of space both when empty and nested or when loaded with articles since the multi-level feature permits adjustment of the stacking distances.

The present invention is directed to a nesting/stacking tray having a tray floor and sidewalls configured to permit nesting or stacking by a selectively movable support member, referred to as a bail member. In a first preferred embodiment, two bail members are used, each preferably hingedly connected to an opposing sidewall. The bail members are preferably movable between three positions: a nested position, a high-stacked position and a low-stacked position. The three positions refer to the relationship between adjacent trays which are nested/stacked together. Movement between the different positions is accomplished by rotating and laterally moving the bails.

In a second preferred embodiment, the tray has opposing sidewalls of different heights, that is, one set of opposing sidewalls are taller than the other set. Bail members are preferably hingeally connected to each sidewall and are selectively movable between two positions: a nested position and a stacked position. Movement between the different positions is accomplished simply by rotating the bail members, no lateral movement of the bails is involved in this embodiment. Three configurations are possible however, since the sidewalls are of varying heights. Placing the bails associated with the higher set of opposing sidewalls in their stacking position, with the other set of bails in their nesting position provides a high-stacked configuration of adjacent trays. Placing the bails associated with the lower set of opposing sidewalls in their stacking position with the other set of bails in their nested position provides a low-stacked configuration of adjacent trays. Setting all of the bails in the nested position provides a nested configuration of adjacent trays.

These and other features and advantages of the invention may be more completely understood from the following detailed description of the preferred embodiments of the invention with reference to the accompanying drawings.

DETAILED DESCRIPTION OF THE PREFERRED EMBODIMENTS

Figure 1:
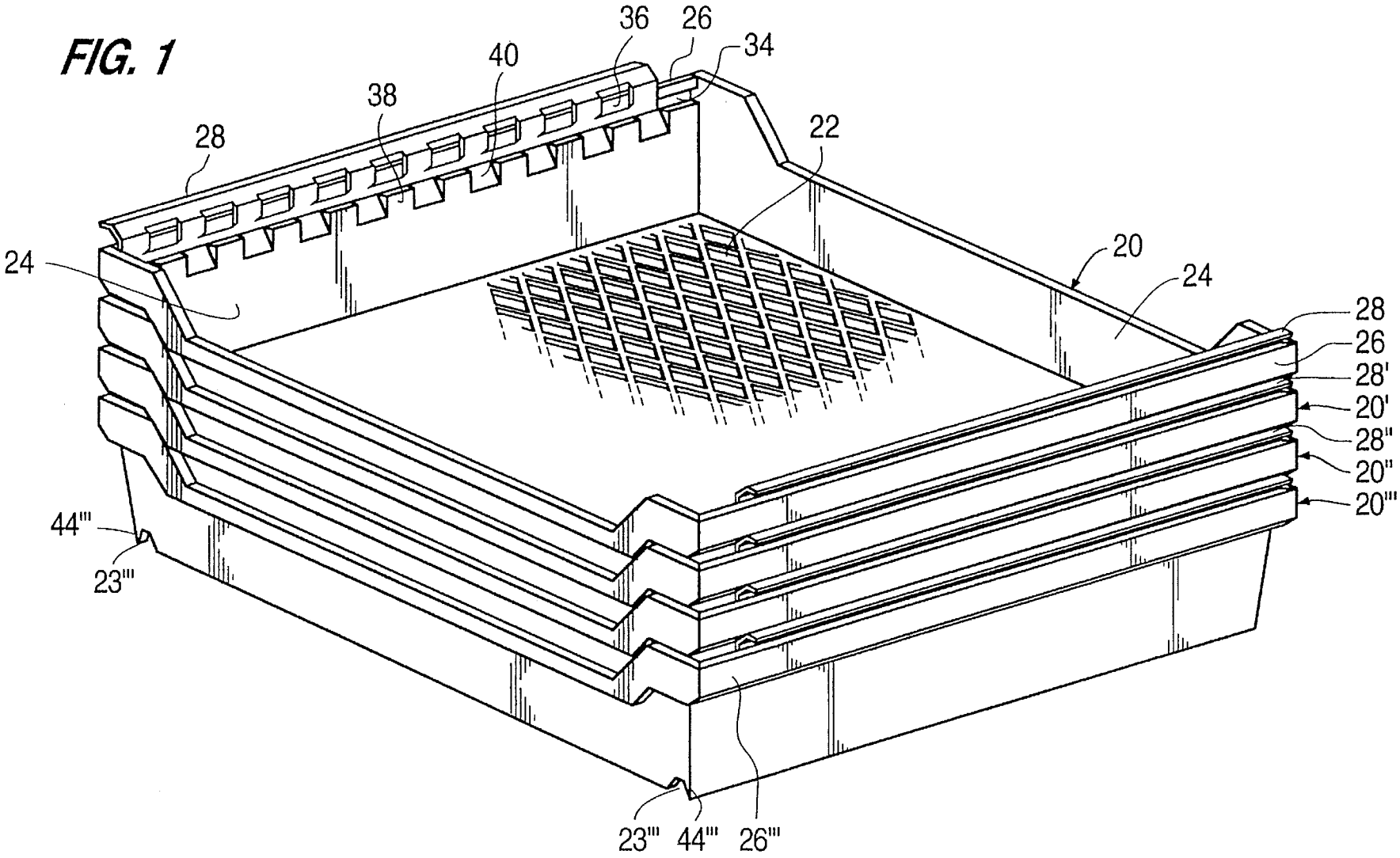
FIG. 1 is a perspective view of a first preferred embodiment of the tray in accordance with the present invention, nested together with three other similar trays.

The present invention is a nestable and stackable tray which has structural features to facilitate stable nesting of empty trays and stacking of loaded trays at different distances from each other. The present invention is especially adaptable for differently sized articles which are transported and stored together.

FIGS. 1–6 illustrate a first preferred embodiment of the present invention. Since many of the advantages of the present invention involve the nestability and stackability of trays, when referring to nested/stacked trays non-primed reference numerals will be used to refer to the tray and primed reference numerals will be used to refer to similar trays nested/stacked therewith. For example, in FIG. 1, tray 20 is empty and nested into tray 20' which is in tum nested into tray 20" and so on. For ease of explanation, the features of the trays are referred to using the same reference numerals distinguished by a prime if referring to a similar tray nested/stacked therewith.

Figure 2:
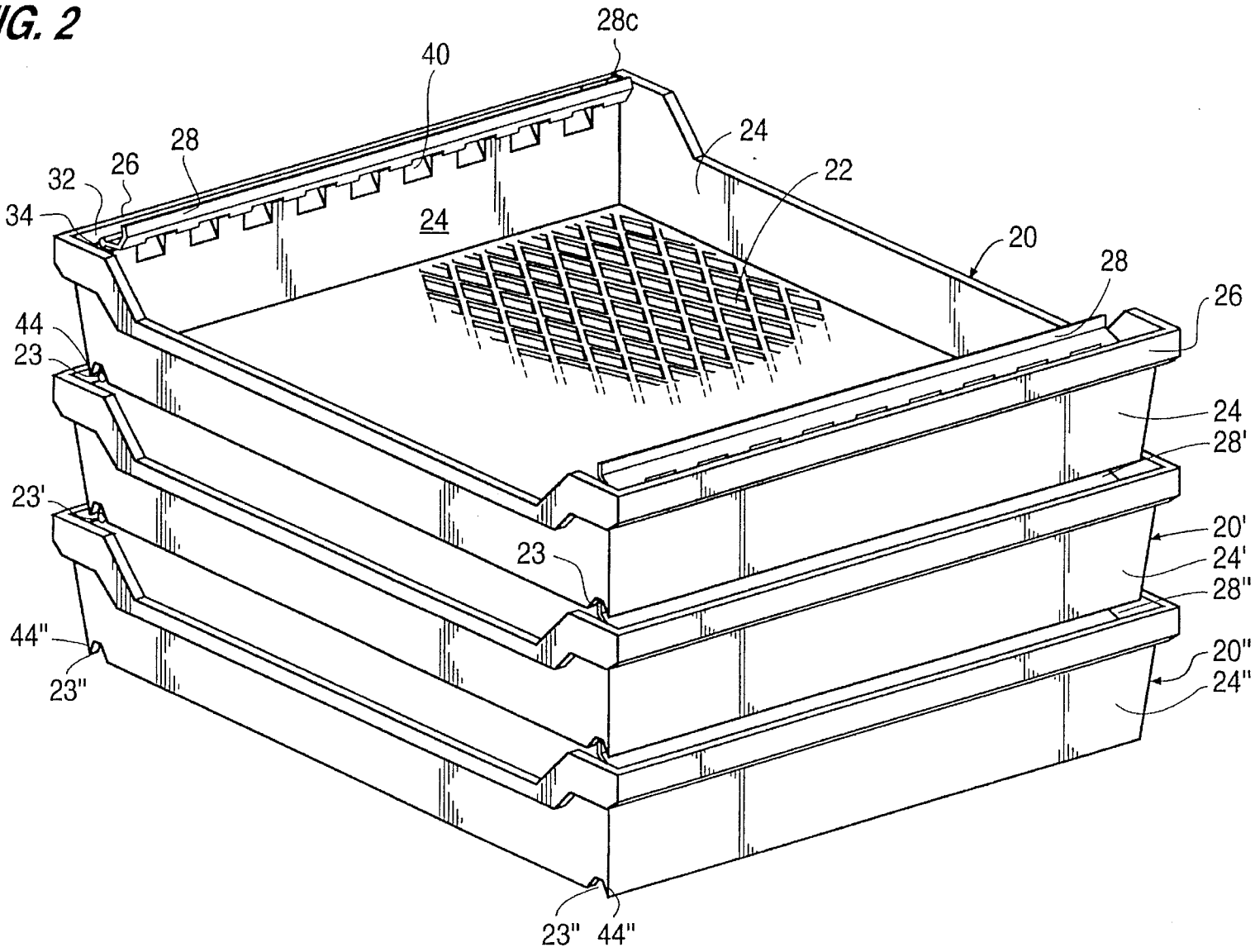
FIG. 2 is a perspective view of the tray of FIG. 1 stacked with two other similar trays in a high stacked configuration.
Figure 3:
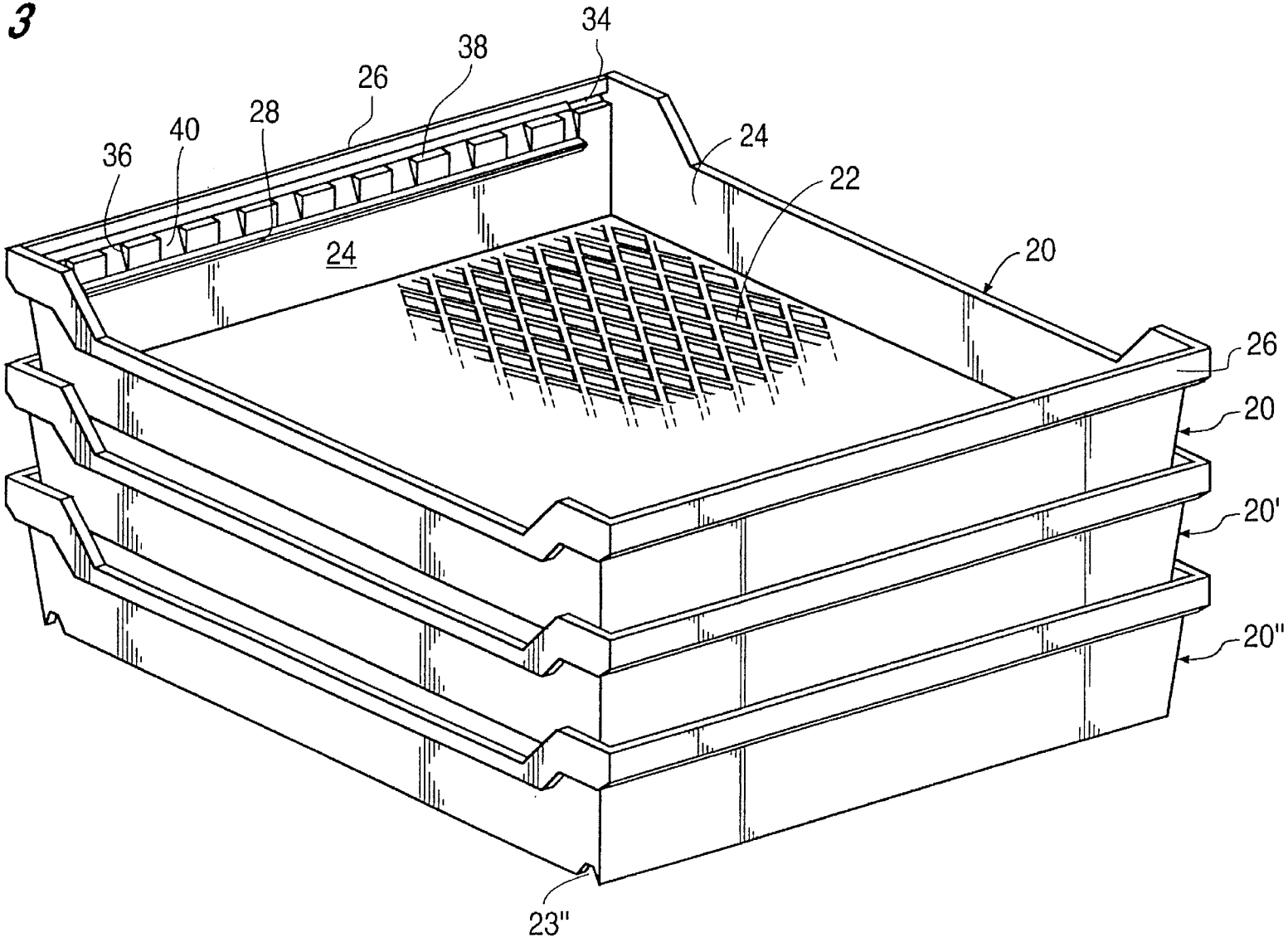
FIG. 3 is a perspective view of the tray of FIG. 1 stacked with two other similar trays in a low stacked configuration.
Figure 6:
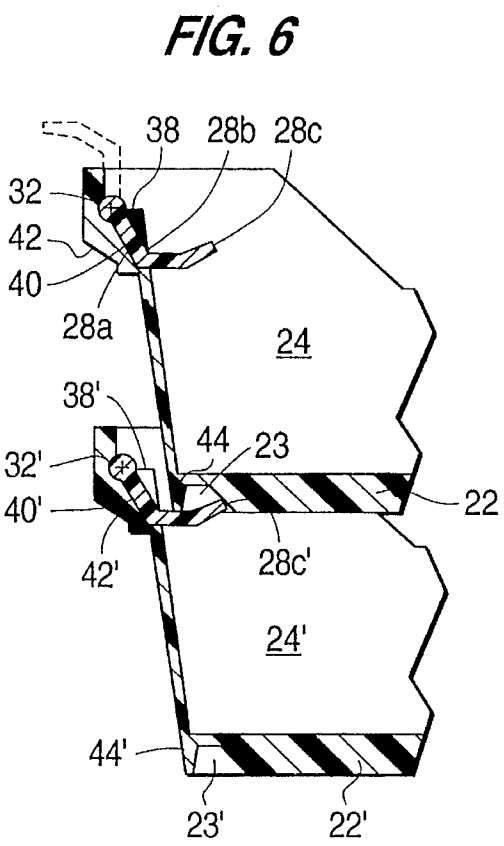
FIG. 6 is a detailed cross-sectional view of the bail and support structure of two trays stacked together in a low stacked configuration as in FIG. 3.
Figure 5:
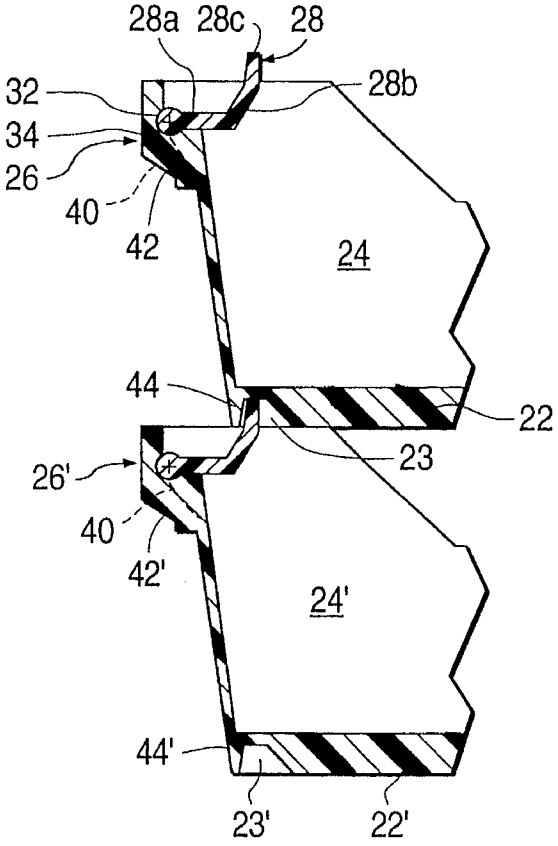
FIG. 5 is a detailed cross-sectional view of the bail and support structure of two trays stacked together in a high stacked configuration as in FIG. 2.
Figure 4:
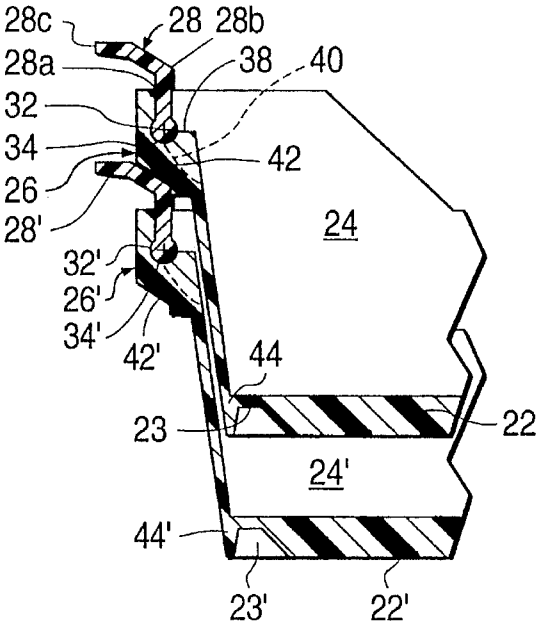
FIG. 4 is a detailed cross-sectional view of the bail and support structure of two trays nested together as in FIG. 1.

FIGS. 1–3 illustrate tray 20 nested or stacked with similar trays in the nested, high-stacked and low-stacked configurations respectively. FIGS. 4–6 illustrate the details of the selectively movable bail members, and correspond to the configurations of FIGS. 1–3 respectively.

FIG. 1 illustrates an empty tray 20 nested with similar trays therebeneath. Tray 20 has a floor 22 with slots 23 on the underside, and sidewalls 24. In the nested configuration, as best seen in FIG. 4, the distance between floors 22 and 22' of adjacent trays is kept at a minimum to make the most efficient use of storage space for empty trays. FIG. 2 illustrates tray 20 stacked with similar trays in a high-stacked configuration wherein the distance between the floors of adjacent trays is kept at a maximum to allow sufficient space for articles held in the trays. As best illustrated in FIG. 5, in the high-stacked configuration adjacent trays 20 and 20' are stacked relative to one another with no overlap of the respective sidewalls 24 and 24'. FIG. 3 illustrates tray 20 stacked with similar trays in a low-stacked configuration with an intermediate distance between the floors of adjacent trays. This configuration is advantageous for loading smaller articles and conserves space. Referring to FIG. 6, in the low-stacked configuration adjacent trays 20 and 20' are stacked relative to one another with slight overlap of the respective sidewalls 24 and 24'. Of course the amount of overlay, and thus the stacking distance of the low-stacked configuration, can be varied to suit the needs of the user by adjusting the sizes of the component parts.

Tray 20 includes on opposing sidewalls, support members 26 onto which bail members 28 are hingedly connected by a hinge connection 30. In the preferred form, support member 26 is an integral part of the tray sidewall. Support members 26 may be a portion of sidewall 24 which protrudes outwardly to provide a support surface. Bail 28 and support 26 of a single sidewall will be described in detail and it will be understood that the bail and support member on the opposite sidewall are identical. Hinge connection 30 preferably comprises a pintle 32 having a circular cross-section which is integrally formed along an edge of bail 28. The edge of bail 28 which includes pintle 32 preferably also includes bail apertures or cut-outs 36. Support member 26 preferably includes an integral socket 34 running preferably along substantially the entire length of sidewall 24. Pintle 32 of bail 28 is inserted into socket 34 and retained there by an interference fit. Bail 28 may be rotated about pintle 32 and may also be moved laterally within socket 34.

Adjacent to socket 34 and integrally formed in support member 26 in an alternating manner are ledges 38 and cavities 40. Ledges 38 and cavities 40 are appropriately sized and arranged cooperate with bail 28 and bail slots 36 to provide the desired nested or stacked configuration. Bail 28 has an elongated shape and preferably has a generally elbow-shaped cross-section. Referring to the cross-sectional views FIGS. 4–6, the portion of bail 28 adjacent pintle 32 and extending radially from the pintle will be designated as 28*a*, the central bend in the bail will be designated as 28*b*, the shelf portion of the bail will be designated as 28*c* and the tip of the bail will be designated as 28*d*.

To achieve the nested configuration illustrated in FIGS. 1 and 4, bails 28' of the lower tray 20' are rotated upward and outward so that radial portion 28*a'* is substantially vertical and tip 28*d'* points outward. When bails 28' are in the nested, that is, "up" position, tray 20 one tray can be inserted down into tray 20'. Referring particularly to FIG. 4, support member 26 of tray 20 has an abutment surface 42 which supports shelf portion 28*c'* of bail 28' of tray 20' therebeneath.

In order to achieve the high-stacked configuration illustrated in FIGS. 2 and 5, bails 28' of the lower tray 20' are rotated downward and inward and moved laterally so that radial portions 28*a'* rest against ledges 38' along the length of sidewalls 24'. This orientation of bails 28' keeps radial portions 28*a'* substantially horizontal, that is, perpendicular to the vertical sidewalls. Central bends 28*b'* and tips 28*d'* of bails 28' are configured so that floor slots 23 of tray 20 stacked thereabove will receive corresponding ones of tips 28*d'* to provide a high-stacked configuration. The high-stacked configuration provides maximum space between tray floors for loading large articles.

Lastly, to achieve the low-stacked configuration illustrated in FIGS. 3 and 6, bails 28' of the lower troy 20' are moved laterally so that apertures 36' are aligned with ledges 38' so that when bails 28' are rotated downward, cavities 40' receive radial portions 28*a'*. Consequently, shelf portion 28*c'* is oriented substantially horizontally with tip 28*d'* pointing inward. When tray 20 is low-stacked onto tray 20' floor foot 44 formed by floor slot 23 is supported on shelf portion 28*c'* of bail 28' and tip 28*d'* of bail 28' is received in floor slot 23. In this manner, tray 20 is stacked atop tray 20' with sidewalls 24 and 24' overlapping to some degree. This low-stack configuration allows for efficient use of space when the trays are loaded with smaller articles.

A simple translation or lateral movement of balls 28 along socket 34 coupled with rotation of the bails about their pintles 32 provides for quick conversion of the trays from nested to low-stacked to high-stacked configurations. The selectively movable bails provide flexible and efficient use of nested and stacked trays. As will be apparent to one of ordinary skill in the art, although groups of trays are shown separately as being nested, high-stacked or low-stacked, any combination of stacking distances is possible within a single group of stacked trays. For example, a single column of trays may have some nested, some high-stacked and others low-stacked as necessary. All that needs to be done is to move the balls into any desired position to achieve nesting, high-stacking or low-stacking. It will also be apparent to the practitioner that a single column of trays having different stacking configurations therein will be vertically aligned since the bail and support member structures are aligned from tray to tray and not offset in any manner such as in the prior art.

Figure 7:
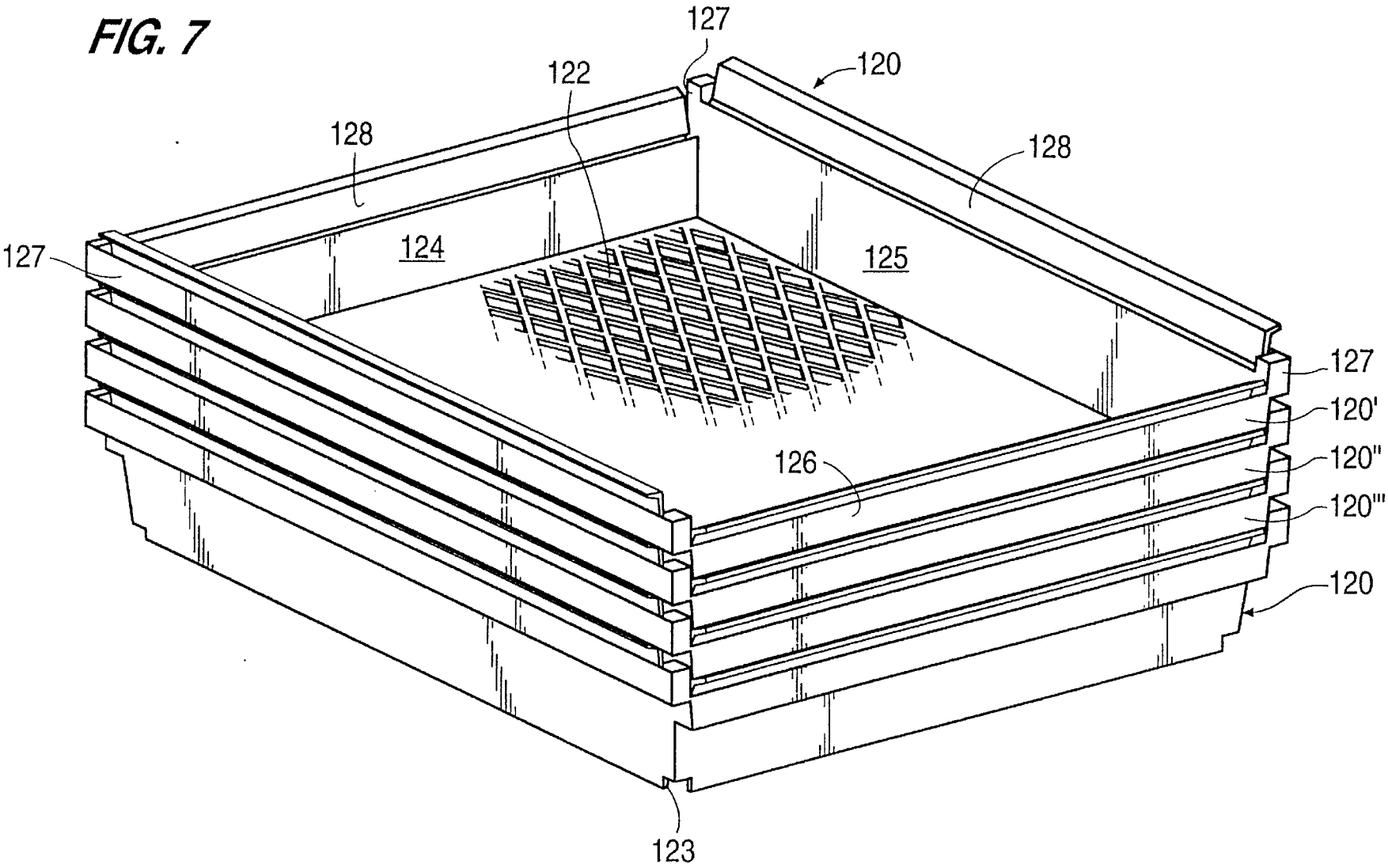
FIG. 7 is a perspective view of a second preferred embodiment of the tray in accordance with the present invention, nested together with three other similar trays.
Figure 8:
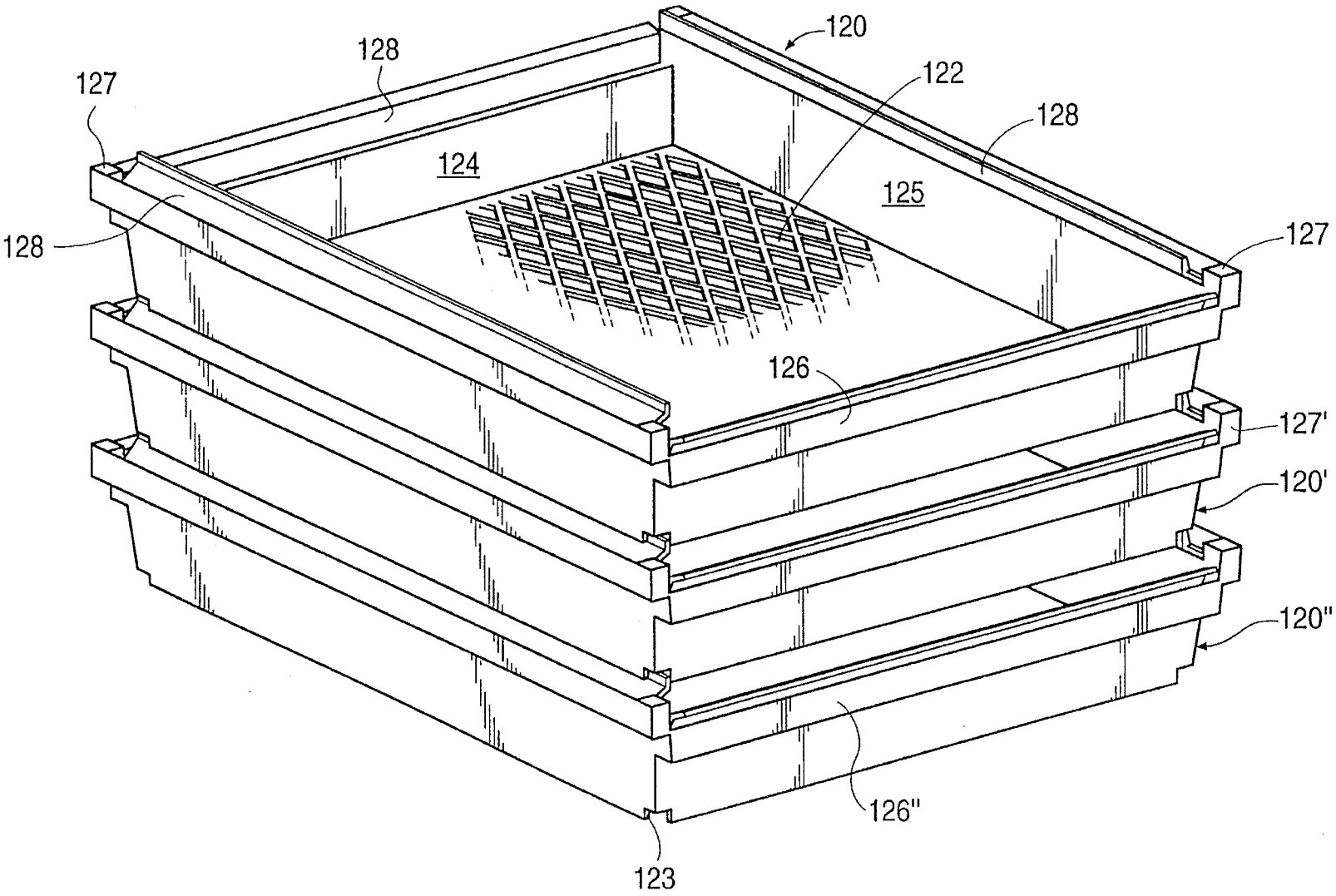
FIG. 8 is a perspective view of the tray of FIG. 7 stacked with two other similar trays in a high stacked configuration.
Figure 9:
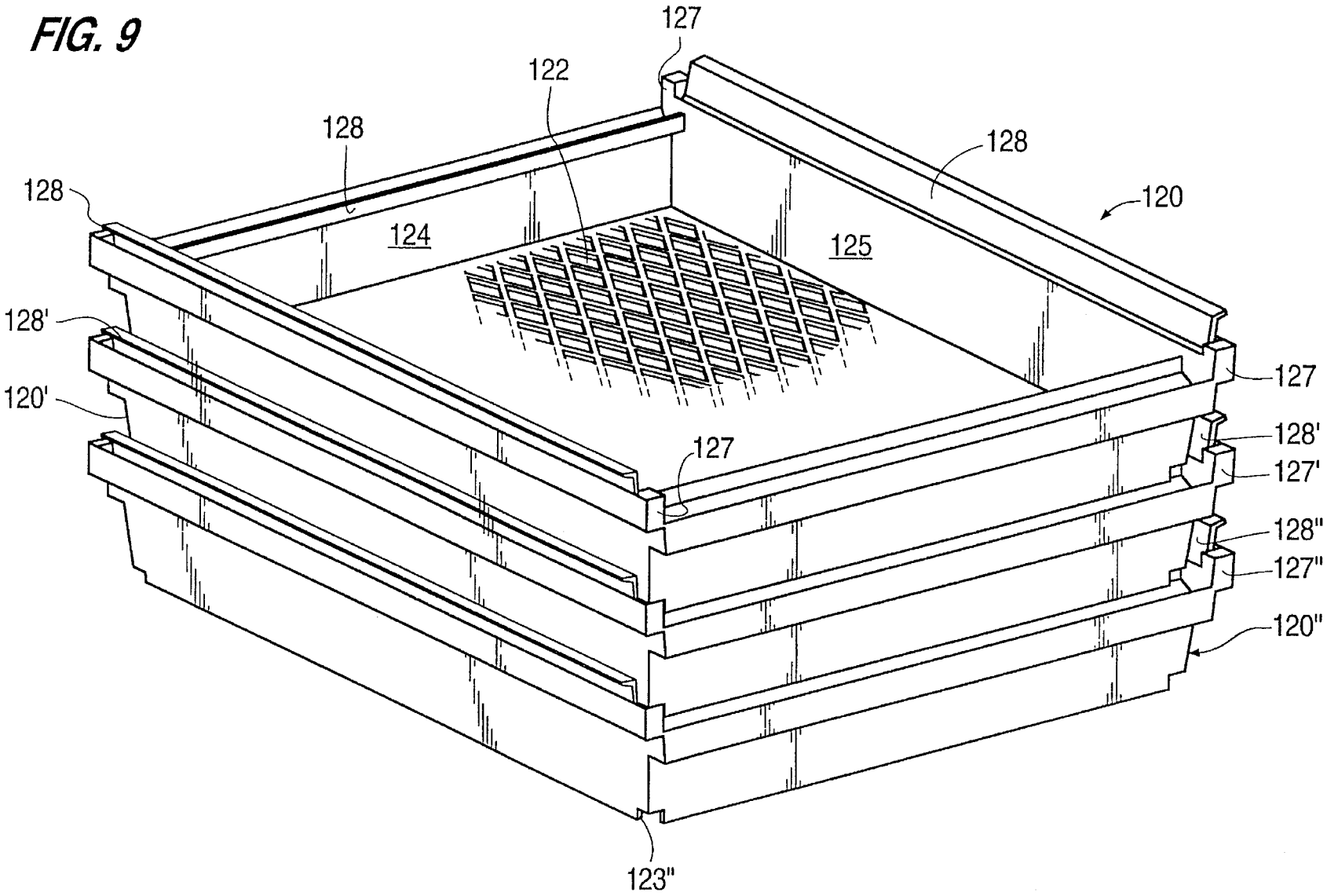
FIG. 9 is a perspective view of the tray of FIG. 7 stacked with two other similar trays in a low stacked configuration.
Figure 10:
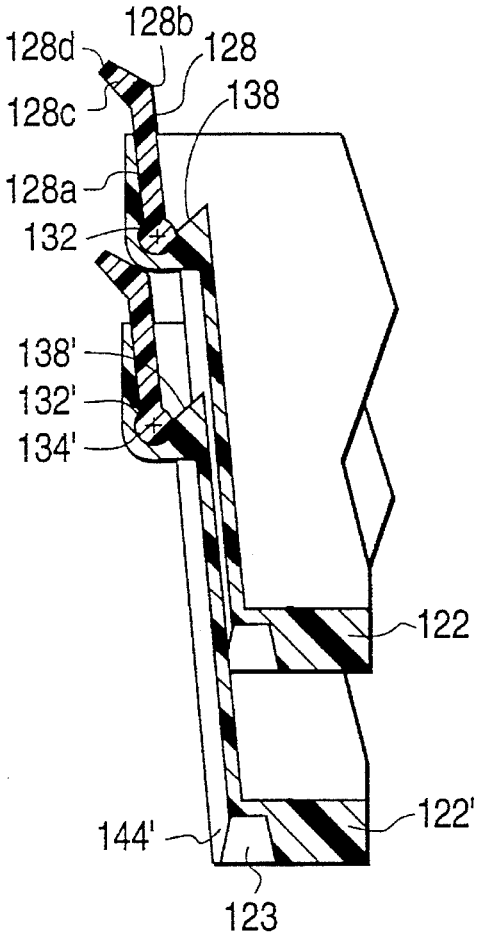
FIG. 10 is a detailed cross-sectional view of a bail and support structure of two trays nested together as in FIG. 7.
Figure 11:
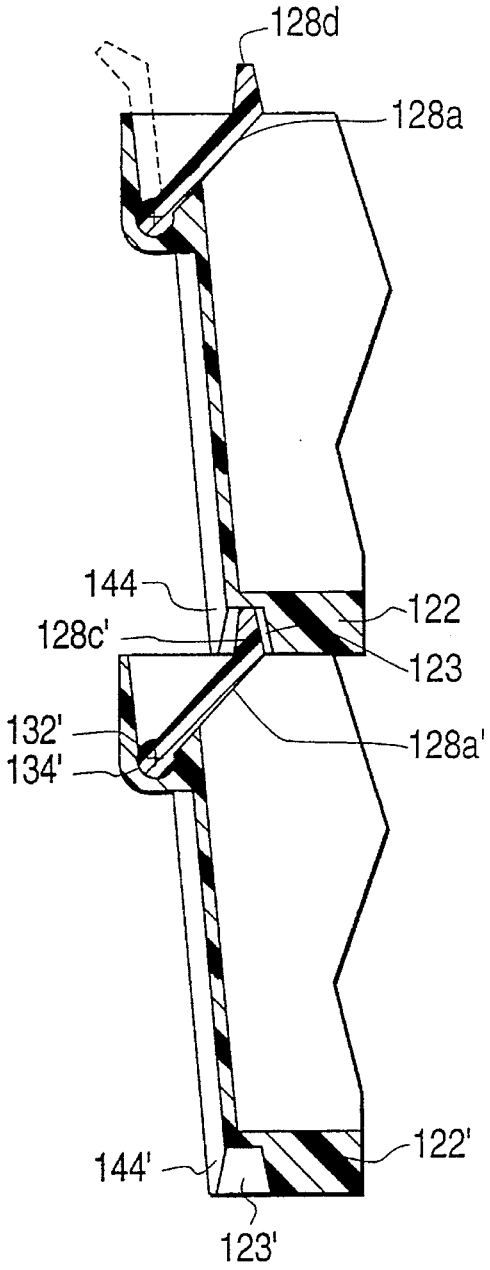
FIG. 11 is a detailed cross-sectional view of a bail and support structure of two trays stacked together as in FIGS. 8 and 9.

FIGS. 7–11 illustrate the second preferred embodiment of the invention which employs bail members on all of the sidewalls of the tray. FIGS. 7–9 illustrate tray 120 nested or stacked with similar trays in the nested, high-stacked and low-stacked configurations respectively. FIGS. 10 and 11 illustrate the details of the selectively movable bail members.

Tray 120 has a floor 122 having floor slots 123 on their undersides, and opposing sidewalls 124 and 125 which are of different heights. Short sidewalls 124 and tall sidewalls 125 include integrally formed identical support members 126. Tall sidewalls 125 may include end posts 127 which are integral with support members 126 on those sidewalls. Bail members 128 are hingedly connected by a hinge connection 130. Support members 126 may protrude outwardly from sidewalls 124 and 125 to provide an overhang. Bails 128 are preferably sized alike and only one bail 128 and support member 126 will be described in detail, and it will be understood that the bail and support member on the other sidewalls are identical.

Hinge connection 130 preferably comprises a pintle 132 having a circular cross-section which is integrally formed along an edge of bail 128. Support member 126 preferably includes an integral socket 134 running preferably along substantially the entire length of sidewall 124, and a ledge 138 adjacent the socket 134. Pintle 132 of bail 128 is inserted into socket 134 and retained there by an interference fit. Bail 128 may be rotated about pintle 132 from the "up" position to the "down" position. Bail 128 has an elongated shape and preferably has a generally elbow-shaped cross-section. Referring to the cross-sectional views FIGS, 10 and 11, the portion of bail 128 adjacent pintle 132 and extending radially from the pintle will be designated as **128*a*, the bend in the bail will be designated as 128*b*, the shelf portion of the bail will be designated as 128*c*, and the tip of the bail will be designated as 128*d*. The main distinction between sidewalls 124 and 125** is their heights, and the operation of the bail and support members are identical.

In order to achieve any of the nested, high-stacked or low-stacked configurations shown in FIGS. 7–9, the bails on either the tall sidewalls or the short sidewalls or both are selectively rotated. Since this second embodiment of the tray depends upon the heights of the opposing sidewalls to vary the stacking configuration, only a rotational movement of the bails is involved. Hence the bails have only two positions, the "up" position and the "down" position with no lateral movement is permitted along the socket. Therefore, the detailed illustrations FIGS. 10 and 11 represent either the bails on the tall or short sidewalls.

To achieve the nested configuration illustrated in FIG. 7, all bails 128' along all sidewalls 124' and 125' of the lower tray 120' are rotated upward and outward so that radial portion **128*a*' is angled slightly outward and tip 128*d*' points outward. When all of the bails 128' are in the nested, that is, "up" position, tray 120 can be inserted down into tray 120' providing a nested configuration. Referring particularly to FIG. 10, support member 126 of tray 120 has an abutment surface 142 which rests on shelf portion 128*c*' of bail 128' of tray 120'** therebeneath.

For the high-stacked configuration of FIG. 8, bails 128' on tall sidewalls 125 of the lower tray 20' are rotated downward and inward while the bails on short sidewalls 124 are kept in the "up" position. As can be seen in FIG. 11, when bails 128' are rotated downward a portion of radial portion **128*a*' rests against ledge 138' so that tip 128*d*' points vertically upward. When tray 120 is stacked thereon, floor slot 123 of tray 120 received tip 128*d*' of bail 128' of the lower tray 120'. In this manner, the bails on the tall sidewalls 125 are employed to provide a high-stacked configuration in which none of the sidewalls of the two trays 120 and 120'** overlap, and provides maximum space between tray floors.

Lastly, for the low-stacked configuration illustrated in FIG. 9, bails 128' on short sidewalls 124' of the lower tray 120' are rotated downward while the bails on tall sidewalls 125' are put in the "up" position. In this manner, when tray 120 is stacked onto a lower tray 120', bails 128' on short sidewalls 124' of the lower tray 120' are received into floor slots 123 along short sidewalls 124 of tray 120. Since bails 128' of tall sidewalls 125' are in the "up" position, tall sidewalls 125 of tray 120 pass downward into tray 120' to provide the low-stacked configuration. Tray 120 is stacked atop tray 120' with tall sidewalls 125 and 125' overlapping to some degree. This low-stack configuration allows for efficient use of space when the trays are loaded with smaller articles.

As with the first embodiment, quick conversion of the trays from the various configuration is provided. In this case, a simple rotation of the bails about their pintles converts the trays from nested to low-stacked to high-stacked configurations. Again, the selectively movable bails on the tall and short sidewalls provide flexible and efficient use of nested and stacked trays. As with the first embodiment, although groups of trays are shown separately as being nested, high-stacked or low-stacked, any combination of stacking distances is possible within a single column of stacked trays. For example, a single column of trays may have some nested, some high-stacked and others low-stacked as necessary. Only the appropriate bails need to be rotated to the desired positions to achieve nesting, high-stacking or low-stacking.

Although the preferred embodiments described above illustrate that the bails are hingedly connected to the sidewalls at the support members, the bails may be connected anywhere on the sidewalls or other tray structure such as at the juncture of a sidewall and tray floor or wholly on the floor or between the top of the sidewall and the floor. Likewise, the preferred embodiments comprise at least two bails, but a single bail is contemplated to be within the scope of the invention such as a cantilever configuration connected to a single sidewall. Additionally, although the floor slots which receive the bails have been described as being disposed on the underside of the floor, bail receiving slots may also be disposed on the tray sidewall structure. The preferred embodiments include three positions each, nested, high-stacked and low-stacked, but more or fewer configurations are contemplated to be within the scope of the invention by varying the shapes and sizes of the bails.

The floors of the trays described above are shown with a grid pattern for illustrative purposes only, but any suitable configuration of the floor is contemplated to be within the scope of the invention such as a lattice pattern, differently sized grid or a solid floor. Similarly, the sidewalls are shown as solid walls but any suitable configuration is contemplated which may include one or more of the following: corrugations, windows, struts and other structural features.

From the foregoing detailed description, it will be evident that there are a number of changes, adaptations, and modifications of the present invention which come within the province of those skilled in the art. However, it is intended that all such variations not departing from the spirit of the invention be considered as within the scope thereof as limited solely only by the claims appended hereto.

I claim:

1. A nesting/stacking tray having a tray floor and upwardly extending tray sidewalls surrounding the periphery of the floor, wherein the improvement comprises:

said tray having a selectively movable member adjustable between a first position and a second position for adjusting the distance between the floor of said tray and the floor of a similar tray nested/stacked therewith;

wherein the tray sidewalls comprise a first set of opposing sidewalls and a second set of opposing sidewalls, and wherein each of said sidewalls includes a selectively movable member movable rotatably about its sidewall from a first position to a second position.

2. A tray as in claim 1, wherein said selectively movable member is movable laterally along and rotatably about a sidewall of said tray.

3. A tray as in claim 2, wherein two opposing sidewalls include a selectively movable member.

4. A tray as in claim 3, wherein said selectively movable members when placed in said first position allows the tray to nestably receive a similar tray and when said movable members are in said second position allows the tray to stackably support a similar tray thereabove.

5. A tray as in claim 4, wherein said second position of said selectively movable correspond to a high-stacked configuration and wherein said selectively movable members are capable of being placed in a third position to allow the tray to stackably support a similar tray thereabove in a low-stacked configuration.

6. A tray as in claim 1, wherein said first set of sidewalls are of a different height than said second set of sidewalls such that said selectively movable members of all said sidewalls when placed in said first position allow the tray to nestably receive a similar tray, and said movable members of said first sidewalls when placed in said first position and said movable members of said second sidewalls when placed in said second position allow the tray to stackably receive a similar tray thereabove.

7. A tray as in claim 6, wherein said movable members of said first sidewalls when placed in second position and said movable members of said second sidewalls when placed in said first position allow the tray to stackably receive a similar tray thereabove.

8. A nesting/stacking tray having a tray floor and first and second pairs of opposing tray sidewalls, said tray comprising:

a support member extending along all of the sidewalls of said tray;

a first pair of balls, each bail hingedly connected to said support member on each of said first pair of opposing sidewalls, said first pair of bails being rotatable between a nested position and a stacked position;

a second pair of bails, each bail hingedly connected to said support member on each of said second pair of opposing sidewalls, said second pair of bails being rotatable between a nested position and a stacked position;

bail receiving slots formed in the tray floor;

wherein when said first pair of bails are in said stacked position and said second pair of bails are in said nested position, said first pair of bails are received in bail receiving slots of a similar tray thereabove to provide a first stacked distance between the floors of the trays; and wherein when said first pair of bails are in said nested position and said second pair of said bails are in said stacked position, said second pair of bails are received in bail receiving slots of a similar tray thereabove to provide a second stacked distance between the floors of the trays, said first stacked distance being different than said second stacked distance; and wherein when both said first pair and said second pair of bails are in said nested position, said support member abuts against said bails to provide a nested position of the trays, wherein the distance between the floors of the trays is less than either the first stacked distance or the second stacked distance.

* * * * *